US010512822B2

(12) United States Patent
Petrov et al.

(10) Patent No.: US 10,512,822 B2
(45) Date of Patent: Dec. 24, 2019

(54) SELF BELAY ARRANGEMENT FOR CLIMBING APPLICATIONS

(71) Applicant: SAFETY ENGINEERING LTD, Sofia (BG)

(72) Inventors: Dimitar Mihaylov Petrov, Sofia (BG); Martin Nikolaev Tapankov, Sliven (BG)

(73) Assignee: Safety Engineering Ltd., Sofia (BG)

( * ) Notice: Subject to any disclaimer, the term of this patent is extended or adjusted under 35 U.S.C. 154(b) by 143 days.

(21) Appl. No.: 15/742,218

(22) PCT Filed: Jun. 23, 2016

(86) PCT No.: PCT/EP2016/064609
§ 371 (c)(1),
(2) Date: Jan. 5, 2018

(87) PCT Pub. No.: WO2017/005504
PCT Pub. Date: Jan. 12, 2017

(65) Prior Publication Data

US 2018/0193702 A1 Jul. 12, 2018

(30) Foreign Application Priority Data

Jul. 8, 2015 (EP) ..... 15175912

(51) Int. Cl.
*A63B 29/02* (2006.01)
*A62B 35/00* (2006.01)
*A62B 1/14* (2006.01)

(52) U.S. Cl.
CPC ..... *A63B 29/02* (2013.01); *A62B 1/14* (2013.01); *A62B 35/0075* (2013.01)

(58) Field of Classification Search
CPC . A63B 29/02; A63B 69/0048; A63B 71/0054; A62B 1/14; A62B 35/0075
See application file for complete search history.

(56) References Cited

U.S. PATENT DOCUMENTS 3,658,151 A * 4/1972 Wisdom ..... A63B 29/02 182/135
4,120,377 A * 10/1978 Charles ..... A63B 27/00 182/135

(Continued)

FOREIGN PATENT DOCUMENTS

FR 2972361 A1 9/2012
WO WO-2011089535 A1 7/2011

OTHER PUBLICATIONS

International Search Report and Written Opinion issued in PCT/EP2016/064609, dated Sep. 28, 2016; ISA/EPO.

*Primary Examiner* — Alvin C Chin-Shue
*Assistant Examiner* — Candace L Bradford
(74) *Attorney, Agent, or Firm* — Harness, Dickey & Pierce, P.L.C.

(57) ABSTRACT

The present invention relates to a self belay arrangement (1) for fall arrest systems, in particular for climbing applications, comprising a locking device (10), to which a rope (11) is attachable, and a connector element (12), which is performed to be attached to a safety harness of a user and to which the locking device (10) is coupled when the user intends to climb up a climbing wall (13), a ladder or other extending structures. According to the invention a retainer element (14) is provided, whereas the retainer element (14) is performed to hold the locking device (10) when the connector element (12) is detached from the locking device (10), and whereas the retainer element (14) interacts with the locking device (10) in such a manner that the connector element (12) must be coupled to the locking device (10) in order to disconnect the locking device (10) from the retainer element (14), Further the invention is directed to a method for connecting and disconnecting a locking device (10) to and from a connector element (12).

12 Claims, 5 Drawing Sheets

(56) References Cited

Figure 1:
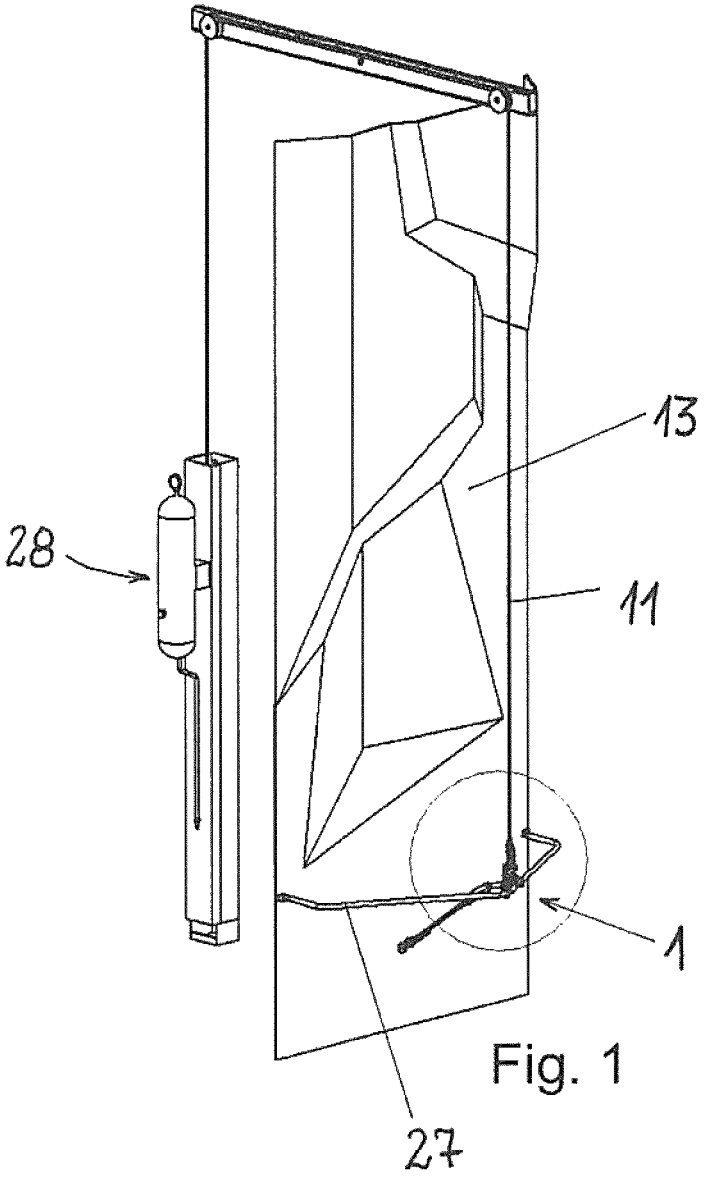

U.S. PATENT DOCUMENTS 4,458,781 A * 7/1984 Ellis ..... E06C 7/186 182/10
4,512,570 A * 4/1985 Tardivel ..... A63B 7/04 182/42
4,546,851 A * 10/1985 Brennan ..... A62B 35/0075 182/7
4,941,548 A * 7/1990 Blanchard ..... A62B 1/10 182/234
4,997,064 A * 3/1991 Motte ..... A62B 35/0093 182/19
5,125,877 A * 6/1992 Brewer ..... A63B 69/0048 482/37
5,146,655 A * 9/1992 Gibbs ..... A44B 99/00 188/65.2
5,593,368 A * 1/1997 Checketts ..... A63B 5/11 482/123
6,083,142 A * 7/2000 Wilson ..... A63B 69/0048 280/DIG. 8
7,600,610 B2 * 10/2009 Deuer ..... A62B 1/06 182/8
8,408,360 B2 * 4/2013 Postma ..... A63B 69/0048 182/18
9,604,087 B2 * 3/2017 Brown ..... A63B 7/045
2002/0084139 A1 * 7/2002 Richard ..... A62B 1/14 182/5
2010/0300809 A1 * 12/2010 Miceli ..... A62B 1/14 182/192
2011/0186388 A1 * 8/2011 Sudale ..... A62B 1/14 188/65.2
2012/0111665 A1 * 5/2012 Paglioli ..... A63B 29/02 182/5
2014/0262610 A1 * 9/2014 Oddou ..... A62B 1/14 182/5
2016/0287913 A1 * 10/2016 Bell ..... A62B 1/20
2017/0050055 A1 * 2/2017 Spydell, Jr. ..... A62B 1/14
2017/0106219 A1 * 4/2017 Sinkaruk ..... A62B 1/14
2017/0296877 A1 * 10/2017 Bennett ..... A63B 69/0048
2018/0021602 A1 * 1/2018 Rogelja ..... A62B 1/14 188/65.2

* cited by examiner

SELF BELAY ARRANGEMENT FOR CLIMBING APPLICATIONS

CROSS REFERENCE TO RELATED APPLICATIONS

This application is a U.S. National Phase Application under 35 U.S.C. 371 of International Application No. PCT/EP2016/064609 filed on Jun. 23, 2016 and published in English as WO 2017/005504 A1 on Jan. 12, 2017. This application claims priority to European Application No. 15175912.3 filed on Jul. 8, 2015. The entire disclosures of all of the above applications are incorporated herein by reference.

The present invention relates to a self belay arrangement for fall arrest systems, in particular for climbing applications, comprising a locking device, to which a rope is attachable, and a connector element, which is performed to be attached to a safety harness of a user and to which the locking device is coupled when the user intends to climb up a climbing wall, a ladder or other extending structures.

PRIOR ART

U.S. Pat. No. 6,083,142 A1 discloses a climbing arrangement with a climbing wall, and a user is secured by a rope in order to prevent the user falling off the wall. The rope is guided via guide pulleys, and the pulleys are mounted on top of the wall, and the wall arrangement comprises an auto-belay device for a permanent tensioning of the rope. When the user releases the wall, the auto-belay device secures the user and lifts down the user to the ground with a controlled down-lifting rate. By means of the auto-belay device the rope is permanent pre-stressed with a minimum force in order to tense the rope into the—usually—vertical direction. In the case when the user is standing on the ground in front of the climbing wall, and the user releases the locking device to which the rope is attached, the rope and the locking device travel to the pulley on the top of the wall due to the base-force generated by the auto-belay device. Accordingly, the locking device must be pulled down again, which case has to be prevented advantageously.

Usually the user connects the locking device to the connector element, which is fixed to the safety harness of the user. The connecting and the disconnecting happen by hand in a generally well known manner, and in unlucky cases the user releases the rope with the locking device, Even if the locking device is fixed to a fixing element in the bottom area of the climbing wall, the case is not entirely preventable that the user releases the locking device, which is pre-stressed by the auto-belay device, and thus the rope travels upwards in an uncontrolled manner.

Moreover, standard self belay arrangements comprise locking devices which can be disconnected from a connector element as a part of the safety harness of the user at any time, in particular unintentional and for example on high, which is dangerous and the user is to prevent from this situation.

Moreover, standard self belay arrangements can be unintentionally connected to a wrong accessory loop or piece of clothing or so instead to the proper connector element as a part of the safety harness of the user, which is dangerous and the user is to prevent from this situation.

DISCLOSURE OF THE INVENTION

Thus, the invention has the objective to eliminate the above mentioned disadvantages. In particular, it is an objective of the present invention to provide a self belay arrangement, which avoids connection to a wrong element or releasing of the locking device and the rope, respectively.

This objective is achieved by a self belay arrangement as taught by claim 1 and as taught by a method according to claim 10. A preferred embodiment of the invention is defined by the subclaims.

The invention relates to a retainer element, whereas the retainer element is performed to hold the locking device when the connector element is detached from the locking device and whereas the retainer element interacts with the locking device in such a manner that the connector element must be coupled to the locking device in order to disconnect the locking device from the retainer element.

The core idea of the inventive self belay arrangement is the permanent received situation in use of the locking device to which the rope is attached. The locking device is either connected to the retainer element when it is not in use or the locking device is attached to the connecter element in use, which is performed to be attached to the safety harness of the user. As a result, the situation is prevented to connect to a wrong element of the harness or to the clothing or to release the locking device being pulled up to the top of the climbing wall by means of the auto-belay device. This situation is prevented because the connector element must be coupled to the locking device first, and only after coupling the connector element to the locking device, the locking device can be disconnected from the retainer element. In the same way the locking device is only detachable from the connector element after attaching the locking device to the retainer element.

Another advantage of the self belay arrangement according to the invention is an advanced safety of the user, because the locking device cannot be decoupled from the connector element when the user is on high. In particular the user cannot disconnect the rope from the safety harness in an unintended manner, in particular the user can not disconnect the rope from the safety harness when the user does not have the retainer element to his disposal. As a consequence by means of the inventive provision of the retainer element the safety of fall arrest systems is enhanced. Moreover, the locking device can only be disconnected from the retainer element when the connection between the locking device and the connector element is performed correctly. Accordingly, the user may not be released from the retainer element (at the bottom) and cannot ascend a wall or the like with an incorrect connection between the rope and his safety harness.

As a principle, the self belay arrangement is permanently connected to a fall arrest device, which is performed either by the retainer element or by the connector element. The retainer element is permanently connected to any type of an access blocking fixture, for example formed by a holding bar which is situated in the bottom area of the climbing wall and in particular in a height above the ground, corresponding to the height of the connector element which is attached to the safety harness of the user. According to another requirement, the connector element must be permanently attached to the safety harness of the user, either directly or by means of a flexible member.

In its preferred embodiment the locking device features a receiving mouth for receiving the connector element when the connector element is coupled to the locking device, and the locking device features a retainer opening for retaining at least a part of the retainer element when the locking device is attached to the retainer element.

The receiving mouth forms a first opening of the locking device in order to receive the connector element, the retainer opening features a receiving means for at least a part of the retainer element forming a kind of a key, which key releases the connector element from the locking device when the locking device is attached to the retainer element, and a third opening, in the sense of completeness, the locking device can feature an opening to attach the rope to the locking device.

According to yet another improvement of the self belay arrangement the locking device features securing means, whereas the securing means are movable arranged in the locking device to secure and release a connector element to or from the locking device, whereas the securing means are performed to interact with the retainer element. In particular, the retainer element features a key element, whereas when the locking device is attached to the retainer element, the key element extends into the retainer opening of the locking device for interacting with the securing means. The securing means can be blocked or released by the key element by extending the key element into the retainer opening or by retracting the key element out of the retainer opening. In the same way, the securing means secure and release the connector element, depending on the key element extending into the retainer opening or the key element, which is retracted out of the retainer opening.

Yet another improvement embodied in the present invention is a connector element which features at least one profiled section, whereas the profiled section interacts with the securing means when the connector element is connected to the locking device. The interaction is performed in such a way that the securing means release the locking device from the retainer element only when the connector element is coupled to the locking device.

According to yet another embodiment of the present invention the locking device comprises at least one locking anchor, whereas the locking anchor is formed to interact with the securing means and with the key element of the retainer element, when the locking device is attached to the retainer element. In particular, the locking device comprises two locking anchors and each locking anchor may feature a first section for interacting with the key element and may feature a second section for interacting with the securing means.

According to another advantage, the locking anchor is received within the locking device via a hinge and is biased by means of a spring element. The spring element biases the locking anchor into an engaging situation with the securing means and only when the key element of the retainer element is inserted into the retainer opening, the key element moves the locking anchor from the engaging situation into the securing means into a releasing situation against the biased force of the spring element.

According to an advantageous design of the securing means, the securing means comprises at least one rotating disc, in particular two or preferred three rotating discs, whereas the rotating disc features a notch in which the locking anchor inserts, when the locking device is disconnected from the retainer element. The movability of the at least one rotating disc within the locking device concerns a rotating movement, which is blocked by engaging the locking anchor into the notch, which notch is for example arranged in the outer circumference of the at least one rotating disc.

Yet another improvement embodied in the present invention is a key element, which features an undercut geometry so that the key element holds within the retainer element due to an interaction of the undercut geometry with the locking anchor. This leads to the advantage that the locking device cannot be disconnected from the retainer element until the, connector element is coupled to the locking element and releases the key element. The release of the key element by means of the connector element attached to the locking device bases on the profiled section of the connector element, which functions as a key and the at least one rotating disc functions as a latch element. The releasing of the key element which is interconnected with the locking anchor bases on a pre-defined rotating position or the at least one rotating disc. Only when the connector element is inserted into the receiving mouth of the locking device, the rotating disc turns into the releasing position and the key element gets released by the locking anchor, because the section of the locking anchor is allowed to engage into the notch within the rotating disc. For this engagement, the rotating disc needs a pre-defined rotating position, namely when the notch is aligned with the engaging section of the locking anchor.

The present invention is also directed to a method for connecting and disconnecting a locking device to and from a connector element of a self belay arrangement arrangement for fail arrest systems, in particular for climbing applications, whereas a rope is attached to the locking device for securing a user during climbing and whereas the connector element is attached to a safety harness of the user, whereas the method comprises at least the following steps: providing a retainer element which holds the locking device when the connector element is disconnected from the locking device, coupling the connector element to the locking device, and automatic releasing of the locking device from the retainer element due to the coupling of the connector element to the locking device. Further features and dedicated advantages which are described in conjunction with the self belay arrangement are also applicable to the inventive method as described above.

According to an improvement of the method the connector element causes a release of the interconnection between the locking device and the retainer element when the connector element is attached to the locking device. According to another advantage, the retainer element causes a release of the interconnection between the locking device and the connector element when the locking device is attached to the retainer element.

The aforementioned components as well as the claimed components and the components to be used in accordance with the invention in the described embodiments are not subject to any special exceptions with respect to their size, shape, material selection and technical concept such that the selection criteria known in the pertinent field can be applied without limitations.

PREFERRED EMBODIMENT OF THE INVENTION

Figure 2:
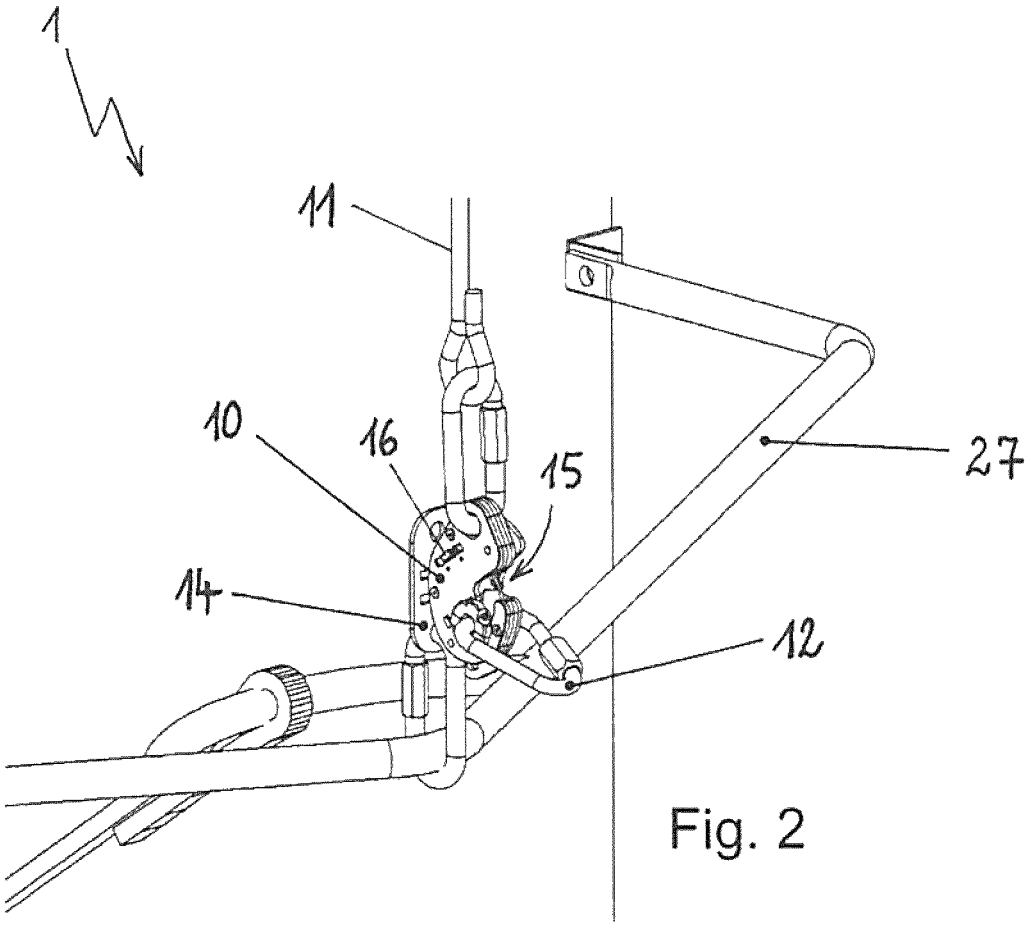
Figure 3:
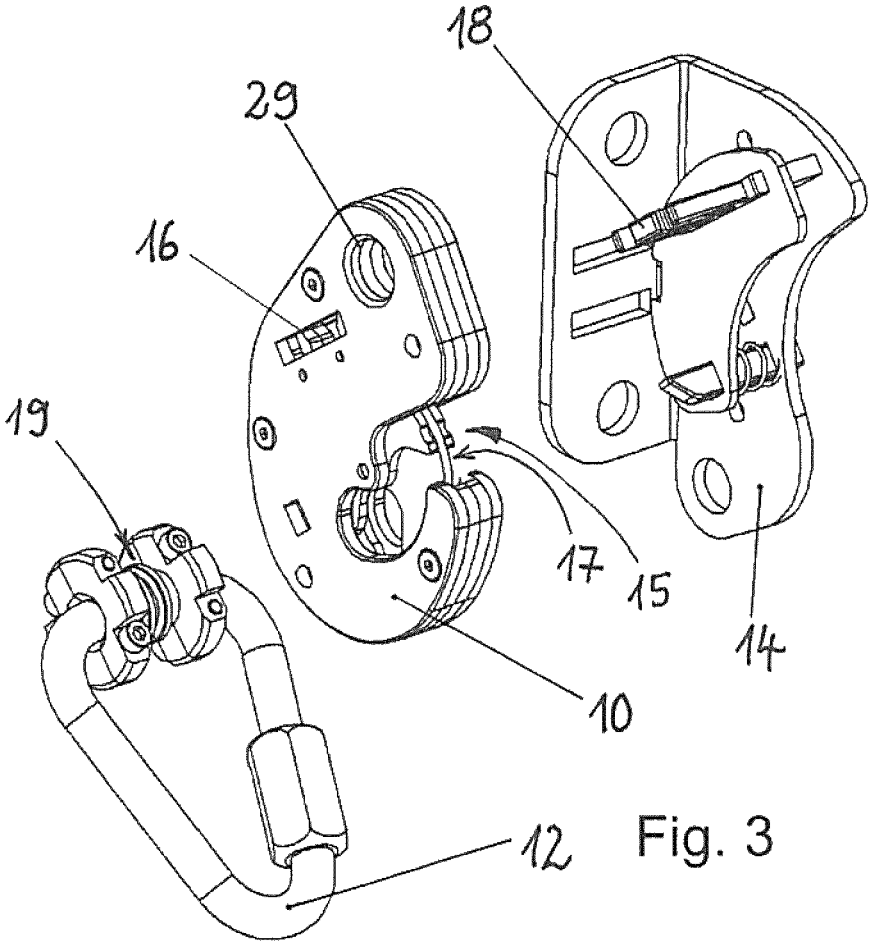
Figure 4:
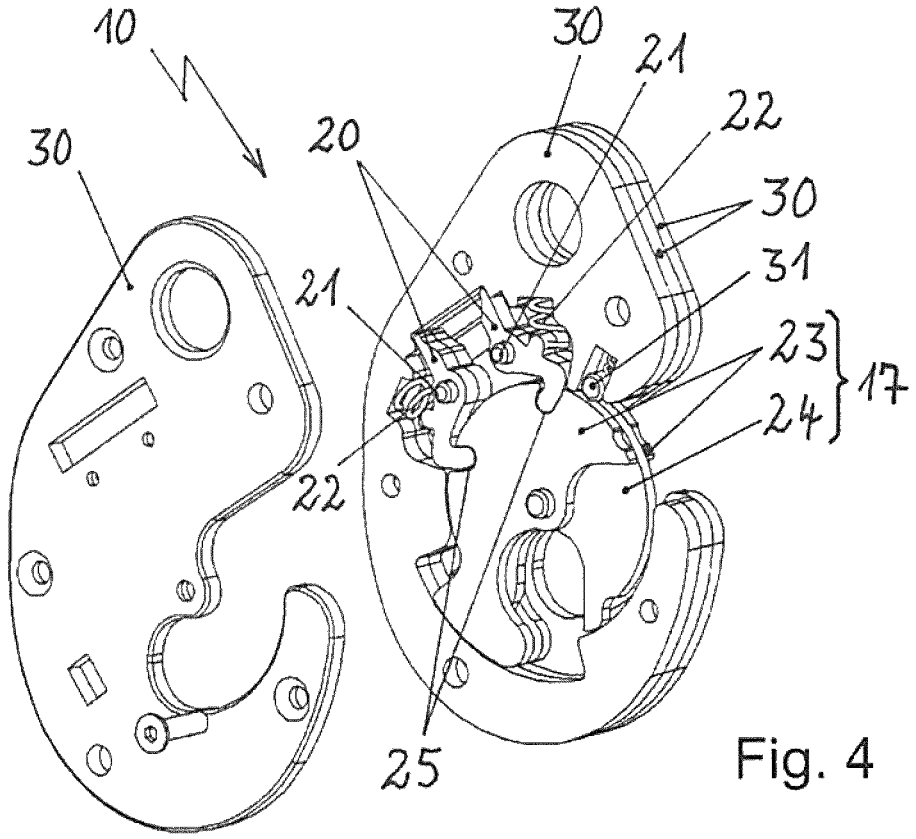
Figure 5:
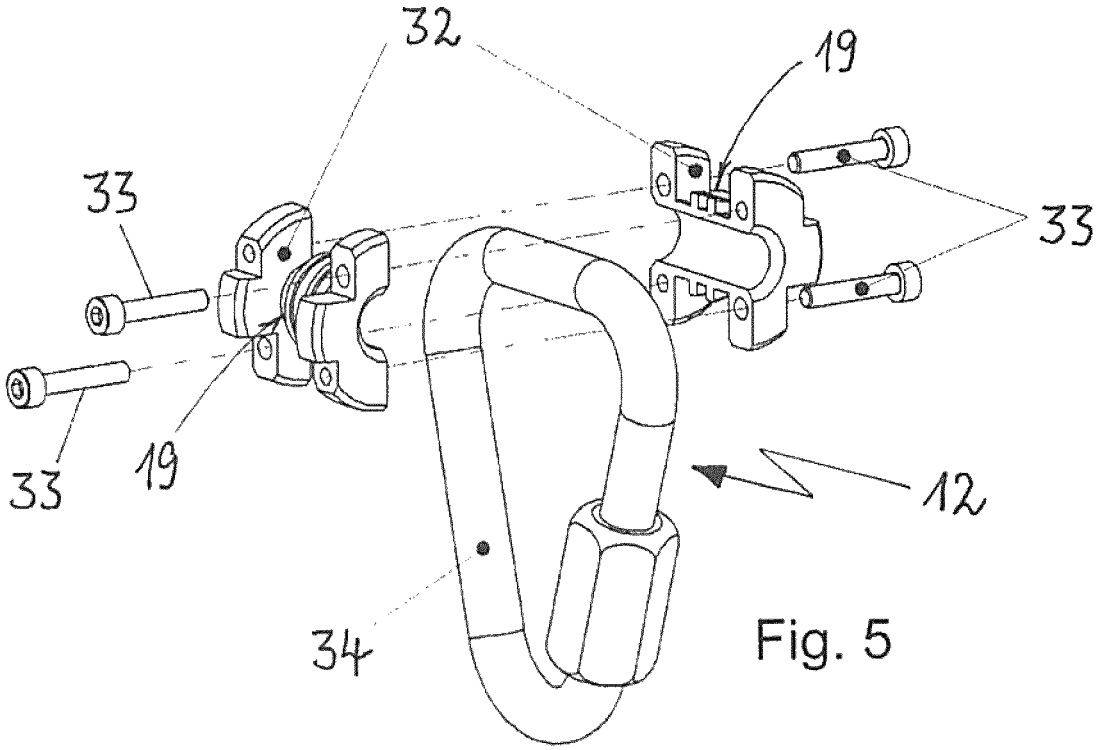
Figure 6:
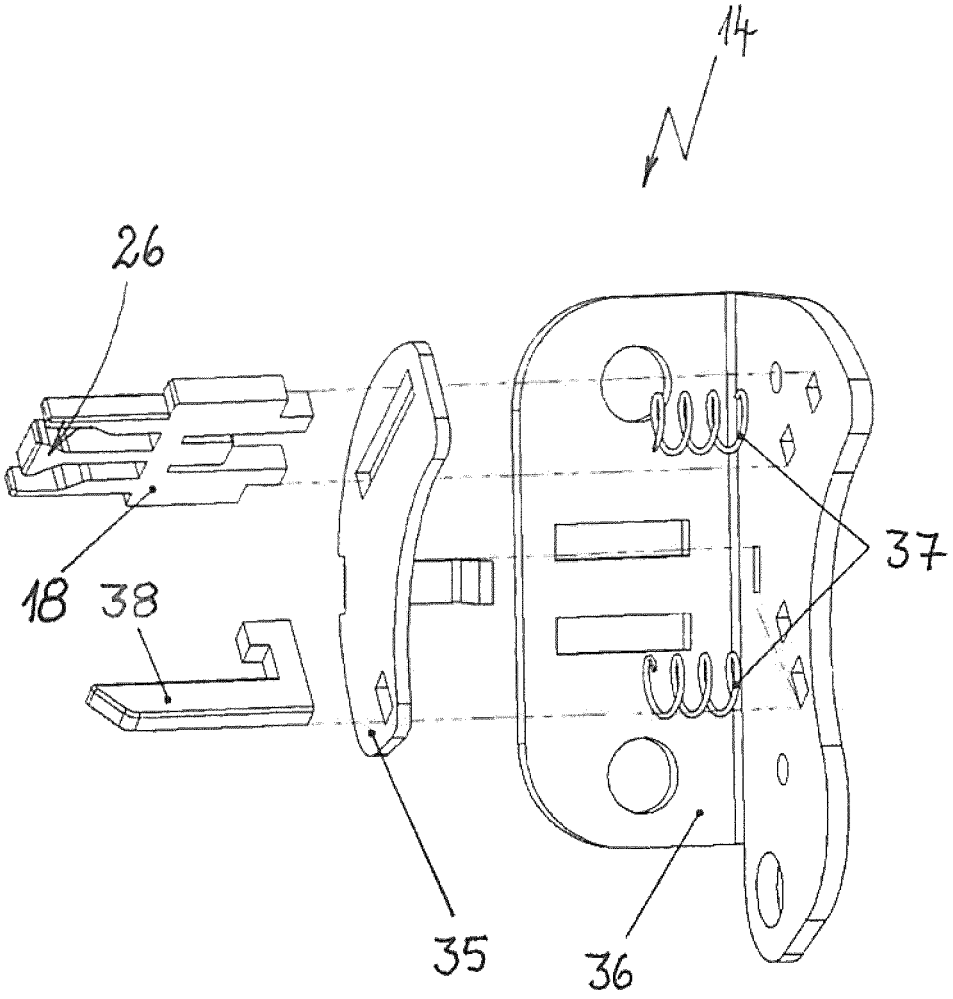

Additional details, characteristics and advantages of the subject matter of the invention are disclosed in the subclaims and the following description of the respective figures, which show preferred embodiments in an exemplary fashion of the subject matter according to the invention in conjunction with the accompanying figures, in which:

FIG. 1 shows an overall view of a climbing wall with a self belay arrangement in front of the climbing wall, FIG. 2 shows a detailed view of the self belay arrangement according to the circled detail depicted in FIG. 1, FIG. 3 shows a detailed view of the main components of the se belay arrangement, FIG. 4 shows a detailed view of the locking device, FIG. 5 shows a detailed view of the connector element and FIG. 6 shows a detailed view of the retainer element.

FIG. 1 shows an overall view of a climbing wall 13 and with a self belay arrangement 1 for holding the rope 11 in a stand-by position. The self belay arrangement 1 provides the rope 11 for connecting to the connector element of a user, whereas the rope 11 is pre-stressed with a base-force by an auto-belay device 28 on the back-side of the climbing wall 13. The rope 11 stays securely locked to the holding bar 27 until a user connects a connector element to the self belay arrangements 1 as described in conjunction with FIG. 2 following in detail.

FIG. 2 shows a detailed view of the self belay arrangement 1 as a connecting arrangement of the rope 11 to the holding bar 27, The locking device 10 is attached to the rope 11 and the locking device 1 is also attached to a retainer element 14, which is connected to the holding bar 27 by means of an additional holding element. Moreover a connector element 12 is shown, which is inserted into a receiving mouth 15 of a locking device 10. Once the connector element 12 is fully inserted into the receiving mouth 15, the locking device 10 can be detached from the retainer element 14 and the locking device 10 in a secured conjunction with the connector element 12 is released to be removed out of the way.

Once, removed from the situation as depicted in FIG. 2, the locking device 10 and the connector element 12 cannot be separated until the device is inserted firmly back into the retainer element 14, thus forming a secure connection between the fall arrest device and the users harness (not shown) while the locking device 10 is detached from the retainer element.

In other words, the connector element 12 functions as a key to release the interconnection between the locking device 10 and the retainer element 14 when the connector element 12 is attached to the locking device. In the same manner the retainer element 14 functions as a key to release the interconnection between the locking device 10 and the connector element is 12, when the locking device 10 is attached to the retainer element 14.

As a result, the user is constantly secured either by blocking the access or by safely connecting them to a fall arrest device, given by the auto-belay device 28 in arrangement with the climbing wall 13.

The locking device 10 features a retainer opening 16 next to the receiving mouth 15 for receiving the connector element 12, and the retainer opening 16 is performed to receive at least a part of the retainer element 14 as described in conjunction with FIG. 3 below.

FIG. 3 shows a flying view of the locking device 10 in between the connector element 12 and the retainer element 14. The locking device 10 features the receiving mouth 15 in which securing means 17 are arranged, moreover locking device 10 features the retainer opening 16 for receiving a key element 18 which is a part of the retainer element 14.

The connector element 12 features a profiled section 19 and when the connector element 12 is inserted into the receiving mouth 15, the profiled section 19 interacts with the securing means 17. The interaction between the profiled section 19 with the securing means 17 leads to a blocking or releasing of the key element 18 within the retainer opening 16, and only when the profiled section 19 interacts with the securing means 17, the key element 18 can be withdrawn out of the retainer opening 16 of the locking device 10.

FIG. 4 illustrates an embodiment of the locking device 10 that can be used to climb a wall, a ladder or other extending structure and which may be fixed to a rope. The locking device 10 includes a number of plates 30, whereas a number of base plates 30 are situated in between two outer plates 30, which house the entirety of the device 10. The securing means 17 are formed by rotating discs 23 and a third rotating disc 24 which is situated between the two outer rotating discs 23. The discs 23 and 24 prevent the disengaging of the connector element 12 when the blocking device 10 is not arranged at the retainer element 14. A set of locking anchors 20 and their respective spring elements 22 are used to lock the position of the discs 23 and 24 when the locking device 10 is disengaged from the retainer element 14. That locking anchors 20 are activated by means of the key element 18 when the locking device 10 is inserted into the retainer element 14. Said locking anchors 20 when in opened position prevent detachment of the locking device 10 from the retainer element 14. Only one locking anchor 20 is sufficient to prevent detachment of the locking device 10 from the retainer element 14, but, as the embodiment shows, a second locking anchor is added for additional safety. The openings in the plates 30, forming the retainer opening 16, see FIG. 3, are formed in a small slot shape so that the retainer opening 16 cannot be manipulated by hand of the user without using a specialized tool or insert the device 10 into the retainer element 14.

When the locking device 10 is arranged at the retainer element 14, the rotating discs 23 and 24 can be rotated freely by hand or other implement, however that locking device 10 can be removed from the retainer element 14 only if the rotating discs 23 and 24 are rotated at a specific angle insured by the geometry features of the profiled section 19 arranged at the connector element 12. The three discs 23 and 24 thus form a kind of a cipher lock.

A positioning pin 31 and a dedicated spring is used to arrange the discs 23 and 24 at the unlocking position to facilitate an easier insertion of the connector element 12 when the locking device 10 is situated at the retainer element 14.

FIG. 5 illustrates the embodiment of the connector element 12 for use with the locking device 10. That connector element 12 consists of a standard readily available quick link karabiner 34 designed and manufactured as per EN362 and/or EN12275, or corresponding standards for personal protective equipment. Two jaws 32 are attached permanently to that karabiner 34 by means of screw elements 33 or other permanent connection means, either detachable or non-detachable. The external geometry of the profiled section 19 are such that they are compatible with the rotating discs 23 and 24 of the locking device 10 by means when fully inserted into the receiving mouth 15 of the locking device 10 to arrange the rotating discs 23 and 24 so the two locking anchors 20 can lock the rotating discs 23 and 24 in closed position and release the locking device 10 from the retainer element 14. Accordingly, the interconnection between the profiled section 19 of the connector element 12 and the rotating discs 23 and 24 functions according to a key-lock-principal.

Finally FIG. 6 illustrates a detailed flying view of the parts of the retainer element 14 comprising a base plate 36, an ejection plate 35 and dedicated spring elements 37, which biase the ejection plate 35 in a pre-stressing direction.

Moreover, the retainer element 14 comprises a shuffle pin 38 and the key element 18 which features an undercut geometry 26.

The ejection plate 35 in conjunction with the spring elements 37 is used to eject the locking device 10 when the connector element 12 is fully inserted into the receiving mouth 15 of the locking device 10. The shuffle pin 38 is performed to shuffle the rotating discs 23 and 24 when the locking device 10 is fully inserted and consequently firmly depressed in the said retainer element 14, the key element 18 has a special geometry which is described as an undercut geometry 26 that gives two functions: From the one side to unlock the locking anchors 20 when the locking device 10 is inserted in the retainer element 14 and from another side to prevent the locking device 10 to be removed from that retainer element 14 by means of jamming in two locking anchors 20 unless they are fully inserted into the dedicated notches 25 in the rotating discs 23 and 24 (see FIG. 4), which only happens when that connector element 12 is fully inserted into the locking device 10.

The present invention is not limited by the embodiment described above, which is represented as an example only and can be modified in various ways within the scope of protection defined by the appending patent claims.

LIST OF NUMERAL

1 Self belay arrangement
10 locking device
11 rope
12 connector element
3 climbing wall
14 retainer element
15 receiving mouth
16 retainer opening
17 securing means
18 key element
19 profiled section
20 locking anchor
21 hinge
22 spring element
23 rotating disc
24 rotating disc
25 notch
26 undercut geometry
27 holding bar
28 auto-belay device
29 connecting eye
30 plate
31 positioning pin
32 jaw
33 screw element
34 karabiner
35 ejection plate
36 base plate
37 spring element
38 shuffle pin

The invention claimed is:

1. A self belay arrangement for fall arrest systems, in particular for climbing applications, comprising a locking device, to which a rope is attachable, a retainer element, and a connector element, which is performed to be attached to a safety harness of a user and to which the locking device is coupled when the user intends to climb up a structure, wherein the retainer element is performed to hold the locking device when the connector element is detached from the locking device, and whereas the retainer element interacts with the locking device in such a manner that the connector element is coupled to the locking device in order to disconnect the locking device from the retainer element.

2. The self belay arrangement according to claim 1, wherein the locking device includes a mouth for receiving the connector element when the connector element is coupled to the locking device, and the locking device includes an opening for retaining at least a part of the retainer element when the locking device is attached to the retainer element.

3. The self belay arrangement according to claim 1, wherein the locking device includes selectively removable securing means arranged in the locking device to secure the connector element to the locking device, and whereas the securing means interact with the retainer element.

4. The self belay arrangement according to claim 3, wherein the retainer element includes a key element, whereas when the locking device is attached to the retainer element, the key element extends into the retainer opening of the locking device to interact with the securing means.

5. The self belay arrangement according to claim 4, wherein the connector element includes at least one profiled section, whereas the profiled section interacts with the securing means in such a way that the securing means release the locking device from the retainer element only when the connector element is coupled to the locking device.

6. The self belay arrangement according to claim 4, wherein the locking device comprises at least one locking anchor, whereas the locking anchor is formed to interact with the securing means and with the key element of the retainer element, when the locking device is attached to the retainer element.

7. The self belay arrangement according to claim 6, wherein the locking anchor is received within the locking device via a hinge and is biased by a spring element.

8. The self belay arrangement according to claim 6, wherein the securing means comprise at least one rotating disc, whereas the at least one rotating disc features a notch for receiving the locking anchor, when the locking device is disconnected from the retainer element.

9. The self belay arrangement according to claim 6, wherein the key element features an undercut, so that the key element holds within the retainer opening due to an interaction of the undercut with the locking anchor.

10. A method for connecting and disconnecting a locking device to and from a connector element of a self belay arrangement for fall arrest systems, in particular for climbing applications, whereas a rope is attached to the locking device for securing a user during climbing and whereas the connector element is attached to a safety harness of the user, whereas the method comprises at least the following steps:

providing a retainer element which holds the locking device when the connector element is disconnected from the locking device, coupling the connector element to the locking device, releasing the locking device from the retainer element after coupling the connector element to the locking device.

11. The method according to claim 10, wherein the connector element causes a release of the interconnection between the locking device and the retainer element when the connector element is attached to the locking device.

12. The method according to claim 10, wherein the retainer element causes a release of the interconnection between the locking device and the connector element when the locking device is attached to the retainer element.

* * * * *